US010443335B2

(12) United States Patent
Finol et al.

(10) Patent No.: US 10,443,335 B2
(45) Date of Patent: Oct. 15, 2019

(54) APPARATUS, SYSTEMS, AND METHODS FOR A ROTATABLE HANGER ASSEMBLY

(71) Applicant: National Oilwell Varco, L.P., Houston, TX (US)

(72) Inventors: Javier Adolfo Garcia Finol, Edmonton (CA); Glen George Martinka, Lloydminster (CA); S. M. Mamun Ur Rashid, Edmonton (CA)

(73) Assignee: National Oilwell Varco, L.P., Houston, TX (US)

( * ) Notice: Subject to any disclaimer, the term of this patent is extended or adjusted under 35 U.S.C. 154(b) by 87 days.

(21) Appl. No.: 15/691,561

(22) Filed: Aug. 30, 2017

(65) Prior Publication Data

US 2018/0058167 A1 Mar. 1, 2018

Related U.S. Application Data

(60) Provisional application No. 62/382,223, filed on Aug. 31, 2016.

(51) Int. Cl.
*E21B 33/04* (2006.01)
*E21B 17/043* (2006.01)

(52) U.S. Cl.
CPC ..... *E21B 33/0415* (2013.01); *E21B 17/043* (2013.01)

(58) Field of Classification Search
CPC ..... E21B 33/0415; E21B 17/043
See application file for complete search history.

(56) References Cited

U.S. PATENT DOCUMENTS 3,420,308 A * 1/1969 Putch ..... E21B 43/10 166/208
5,383,519 A 1/1995 Wright et al.
5,427,178 A 6/1995 Bland
5,429,188 A * 7/1995 Cameron ..... E21B 33/0415 166/117.7
5,465,788 A 11/1995 Wright
(Continued)

FOREIGN PATENT DOCUMENTS

CA 2108838 C 9/1995
CA 2112601 C 8/1996
(Continued)

OTHER PUBLICATIONS

National Oilwell Varco Catalog: XL Systems, Engineer Connectors, 2013, www.nov.com/xlsystems (20 p.).

*Primary Examiner* — Giovanna C Wright
(74) *Attorney, Agent, or Firm* — Conley Rose, P.C.

(57) ABSTRACT

A tubing hanger for supporting a tubing string from a wellhead includes a unified mandrel having an upper mandrel coupled to an axially aligned lower mandrel by multiple separate connections. The upper mandrel includes an external shoulder, and a lower mandrel includes a threaded segment configured to couple to the tubing string. The first connection is configured to restrain axial movement between the upper and lower mandrel and to transfer toque between the upper mandrel and the lower mandrel in at least a first rotational direction. The second connection is configured to transfer toque between them in at least a second rotational direction opposite the first rotational direction, to prevent the first connection from loosening.

19 Claims, 9 Drawing Sheets

(56) References Cited

U.S. PATENT DOCUMENTS

| | | | | |
|---|---|---|---|---|
| 6,026,898 | A | 2/2000 | Bland et al. | |
| 6,199,630 | B1 | 3/2001 | Blundell et al. | |
| 8,272,434 | B2 | 9/2012 | Garcia | |
| 9,562,404 | B2 * | 2/2017 | Klotz | E21B 33/04 |
| 2006/0093251 | A1 * | 5/2006 | Casey | F16C 35/073 384/538 |
| 2011/0232895 | A1 * | 9/2011 | Klotz | E21B 33/04 166/77.51 |
| 2013/0146305 | A1 * | 6/2013 | Dupal | E21B 19/16 166/380 |

FOREIGN PATENT DOCUMENTS

| | | | |
|---|---|---|---|
| CA | 2141510 | C | 1/1997 |
| CA | 2210239 | A1 | 12/1997 |
| CA | 2203091 | A1 | 10/1998 |
| CA | 2160668 | C | 1/1999 |
| CA | 2296975 | A1 | 8/2000 |
| CA | 2444059 | A1 | 4/2004 |
| CA | 2541142 | A1 | 10/2006 |
| CA | 2707265 | A1 | 9/2011 |

* cited by examiner

APPARATUS, SYSTEMS, AND METHODS FOR A ROTATABLE HANGER ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Field of the Disclosure

This disclosure relates generally to tools and equipment used in the recovery of oil and gas. More particularly, it relates to making threaded connections between tubular members adjacent a well head.

Background to the Disclosure

Operations at a well site include installing a string of tubular members into a previously-drilled well bore. The string includes multiple segments of pipe joined end to end by threaded connections that are commonly torqued together by power tongs that are positioned above the well bore. One type of power tongs has a closed, circular head that spans 360° without a split, the head having a chuck or chucks for gripping tubular members. For this type of power tongs, each subsequent pipe segment to be added to the string is inserted through the top of power tongs. It is then threaded and torqued to the uppermost pipe segment of the string that is already in the well bore and being temporarily held at the top of the well bore by wedges or other means to keep them vertically fixed. The tubular string with the added pipe segment is then lowered through the power tongs and again held below the power tongs by wedges, and another pipe segment is added through the tongs from above. When the tubular string is so constructed to the desired length, it is lowered below the level of the power tongs, the power tongs are removed from the top of the well bore, and the tubular string is connected to other equipment to continue the well operation.

For production operations, the final or upper member of the tubular string commonly includes a hanger assembly having a hanger head with a larger diameter than the remainder of the tubular members in the string, and larger than the closed, gripping head of the power tongs. The hanger assembly also needs to be threaded and torqued to the other, downhole members of the tubular string. For some hanger assemblies, the power tongs cannot be used because the large diameter of the hanger head cannot pass through the opening in the power tongs after the connection and torqueing is complete, and would trap the power tongs at the well head. In such cases, manual tongs may be used, but they lack the same mechanical advantage as provided by power tongs. One conventional solution uses power tongs that have a door that gives horizontal access to the gripping head and its chuck. Another conventional solution uses a hanger assembly having a removable, split head coupled to a more narrow tubular mandrel that has an outside diameter appropriate for fitting within the inside diameter of the closed, gripping head of the power tongs. With the hanger's split head removed, the tubular mandrel is installed through the power tongs and torqued to the remainder of the tubular string as usual, and then lowered. The power tongs can then be moved vertically from the mandrel of the hanger and horizontally, away from the top of the well bore. The split head of the hanger assembly is replaced on the mandrel, and the tubular string is connected to other equipment to continue the well operation.

BRIEF SUMMARY OF THE DISCLOSURE

Disclosed is a tubing hanger for supporting a tubing string from a wellhead that comprises: an upper mandrel having an external shoulder; a lower mandrel axially aligned with and coupled to the upper mandrel by a plurality of connections and having a threaded segment configured to couple threadingly to the tubing string. The first connection is configured to restrain axial movement between the upper mandrel and the lower mandrel and to transfer toque between the upper mandrel and the lower mandrel in at least a first rotational direction. The second connection is configured to transfer toque between the upper mandrel and the lower mandrel in at least a second rotational direction opposite the first rotational direction, to prevent the first connection from loosening. The second connection is axially-spaced from the first connection.

In some embodiments, the tubing hanger comprises an outer mandrel having a through-bore and an external shoulder configured to be supported by the wellhead; wherein the upper mandrel comprises a first portion retained within the outer mandrel through-bore, and a second portion extending axially beyond the outer mandrel through bore; and wherein the first and second connections are positioned at locations that are between the lower mandrel and the second portion of the upper mandrel.

In some embodiments, the wellhead includes a tubing rotator spool piece, and at least a portion of the upper mandrel is received in the tubing rotator spool piece; and the outer mandrel through-bore is configured to permit the upper mandrel to rotate relative to the outer mandrel.

In some embodiments, the first connection comprises mating, non-tapered threads and the second connection comprises: a first radially-extending bore disposed in the upper mandrel, a second radially-extending bore disposed in the lower mandrel, and a pin member configured to be received at least partially within each of the first and second radially-extending bores.

In some embodiments, the tubing hanger includes a sealing member disposed between the upper mandrel and the lower mandrel and spaced-apart from the first and second connections; wherein the first and second connections and the sealing member are proximal a first end of the lower mandrel.

In some embodiments, the first connection comprises mating, non-tapered threads, which may be ACME threads.

In some embodiments, the second connection comprises: a first radially-extending bore disposed in the upper mandrel, a second radially-extending bore disposed in the lower mandrel, and a pin member configured to be received at least partially within each of the first and second radially-extending bores.

In some embodiments, the second connection comprises an annular locking member disposed about at least part of the upper mandrel and at least part of the lower mandrel. In some embodiments, the second connection comprises a key disposed between a first slot in the upper mandrel and a second slot in the lower mandrel.

In some embodiments, the second connection includes a retainer ring circumferentially disposed about at least part of the upper mandrel and at least part of the lower mandrel and configured to retain the key.

Also disclosed is a tubing hanger for supporting a tubing string from a wellhead that includes: an outer mandrel comprising an axially-extending through-bore and an external shoulder configured to be supported by the wellhead; and an upper inner mandrel. The inner mandrel includes: a first portion retained within the through-bore of the outer mandrel; a second portion extending axially beyond the through-bore of the outer mandrel and having a threaded segment comprising non-tapered threads; and a first radially-extending bore. A lower inner mandrel is coupled to the upper inner mandrel and comprises: a first threaded segment comprising non-tapered threads configured to couple the threaded segment of the upper inner mandrel; a second threaded segment distal the first threaded segment of the lower inner mandrel and comprising tapered threads; and a second radially-extending bore aligned with the first radially-extending bore of the upper inner mandrel. A pin member is disposed at least partially within each of the first and second radially-extending bores.

In some embodiments, the outer mandrel is configured to support an axial load from the upper inner mandrel; and the upper inner mandrel is configured to rotate relative to outer mandrel.

The tubing hanger may include a sealing member disposed between the lower inner mandrel and the second portion of the upper mandrel; wherein the threaded segment of the upper mandrel is spaced-apart from the first radially-extending bore of the upper mandrel; and the sealing member is spaced-apart from the threaded segment and the first radially-extending bore of the upper mandrel.

In another embodiment, a tubing hanger for supporting a tubing string from a wellhead comprises: an upper mandrel comprising an external shoulder; a lower mandrel axially aligned with and coupled to the upper mandrel and comprising a threaded segment configured to couple threadingly to the tubing string; a threaded connection between the upper mandrel and the lower mandrel configured for make-up in a first rotational direction and configured to restrain axial movement between the upper and lower mandrels; and a non-threaded connection between the upper mandrel and the lower mandrel configured to transfer toque therebetween in at least a second rotational direction opposite the first rotational direction.

In some embodiments the threaded connection comprises mating, non-tapered threads. In some embodiments, the threaded connection is further configured to transfer toque between the upper mandrel and the lower mandrel in at least the first rotational direction; and the threaded connection is axially-spaced from the non-threaded connection.

In some embodiments, the second connection comprises: a first radially-extending bore disposed in the upper mandrel, a second radially-extending bore disposed in the lower mandrel, and a non-threaded pin member configured to be received at least partially within each of the first and second radially-extending bores.

Disclosed too is a method for coupling threaded tubular members end-to-end comprising: positioning a gripping head of a torqueing device above a well bore; passing tubular members through the gripping head and into the well bore; using the gripping head to join end-to-end the tubular members to form a tubing string; suspending the tubular string in the well bore; aligning a tubular first segment of a tubing hanger with the suspended tubular string; grasping the first segment with the gripping head of the torqueing device; rotating the first segment using the gripping head and threading the first segment into the suspended tubular sting; releasing the first segment of the tubing hanger from the gripping head; lowering the first segment relative to the gripping head and moving the gripping head out-of-alignment with the first segment and the tubular string; coupling a tubular second segment of the tubing hanger to the first segment by making a first connection; and making a second connection between the first segment and the second segment after making the first connection.

BRIEF DESCRIPTION OF THE DRAWINGS

For a detailed description of the disclosed exemplary embodiments, reference will now be made to the accompanying drawings, wherein.

NOTATION AND NOMENCLATURE

Figure 1:
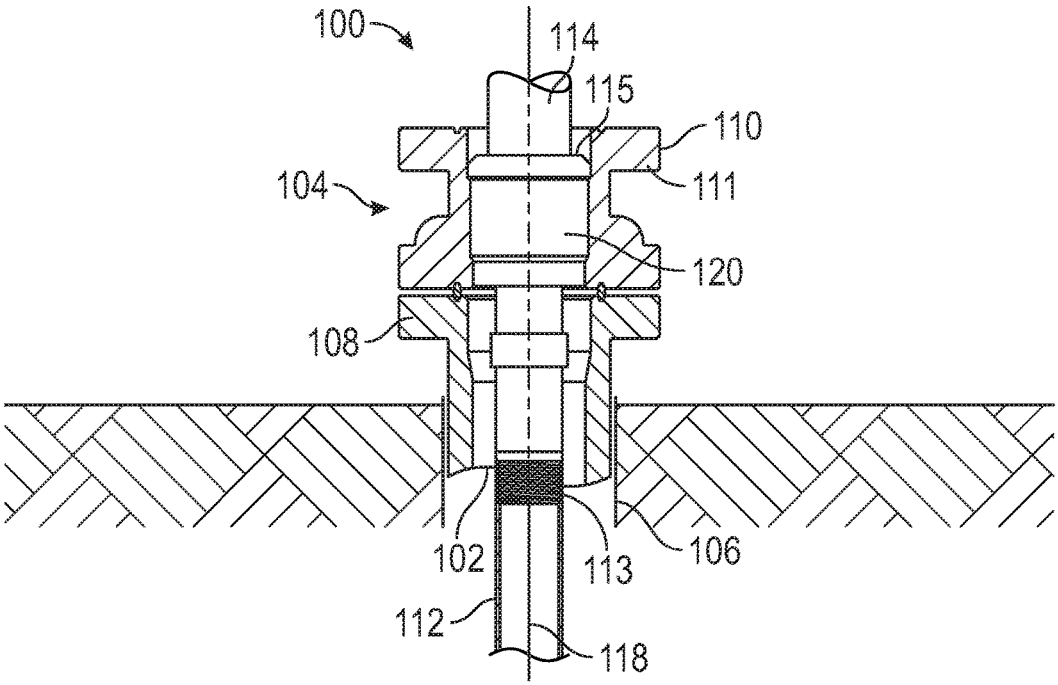
FIG. 1 an elevation view in partial cross-section of an embodiment of a well system having a tubing hanger in accordance with principles disclosed herein.

The following description is exemplary of certain embodiments of the disclosure. One of ordinary skill in the art will understand that the following description has broad application, and the discussion of any embodiment is meant to be exemplary of that embodiment, and is not intended to suggest in any way that the scope of the disclosure, including the claims, is limited to that embodiment.

The figures are not drawn to-scale. Certain features and components disclosed herein may be shown exaggerated in scale or in somewhat schematic form, and some details of conventional elements may not be shown in the interest of clarity and conciseness. In some of the figures, in order to improve clarity and conciseness, one or more components or aspects of a component may be omitted or may not have reference numerals identifying the features or components. In addition, within the specification, including the drawings, like or identical reference numerals may be used to identify common or similar elements.

As used herein, including in the claims, the terms "including" and "comprising," as well as derivations of these, are used in an open-ended fashion, and thus are to be interpreted to mean "including, but not limited to . . . ." Also, the term "couple" or "couples" means either an indirect or direct connection. Thus, if a first component couples or is coupled to a second component, the connection between the components may be through a direct engagement of the two components, or through an indirect connection that is accomplished via other intermediate components, devices and/or connections. The recitation "based on" means "based at least in part on." Therefore, if X is based on Y, then X may be based on Y and on any number of other factors.

In addition, the terms "axial" and "axially" generally mean along or parallel to a given axis, while the terms "radial" and "radially" generally mean perpendicular to the axis. For instance, an axial distance refers to a distance measured along or parallel to a given axis, and a radial distance means a distance measured perpendicular to the axis. Furthermore, any reference to a relative direction or relative position is made for purpose of clarity, with examples including "top," "bottom," "up," "upward," "down," "lower," "clockwise," "left," "leftward," "right" "right-hand," "down", and "lower." For example, a relative direction or a relative position of an object or feature may pertain to the orientation as shown in a figure or as described. If the object or feature were viewed from another orientation or were implemented in another orientation, it may be appropriate to describe the direction or position using an alternate term.

Also, in regard to a well bore or borehole, "up," "upper," "upwardly" or "upstream" means toward the surface of the well bore and "down," "lower," "downwardly," or "downstream" means toward the terminal end of the well bore, regardless of the well bore orientation.

As used herein, including the claims, the plural term "threads" broadly refer to a single, helical thread path or to multiple, parallel helical thread paths, any of which may include multiple, axially spaced crests and troughs. Further, "tapered threads" refers to the typical meaning in which threads are formed along a generally frustoconical surface, about a central axis; the surface and therefore the threads taper from a first diameter to a second diameter as the surface extends along the central axis. Examples of tapered threads include American Petroleum Institute (API) External Upset End (EUE) threads and API Non-Upset End (NUE) threads. Various embodiments of tapered threads may be described as high-tightening-torque threads because significant torque is applied to make-up a connection between a pair of the tapered threads. For oilfield work, the make-up of connections having API tapered threads is performed with torqueing device such as a pipe wrench or a power tongs.

Still further, as used herein, including in the claims, "non-tapered threads," are formed along a non-tapering or straight outer surface region of a member, the outer surface region having a nominal outside diameter that is generally uniform and therefore does not taper. Non-tapered threads may also be called straight threads and include, as examples, ACME threads and UNC threads. In general, the make-up of connections between pairs of non-tapered threads can be performed without using a torqueing device such as a pipe wrench or a power tongs, devices which are configured to apply a significant mechanical advantage resulting in a significant torque.

DETAILED DESCRIPTION OF THE DISCLOSED EXEMPLARY EMBODIMENTS

The description here presents various apparatus, assemblies, techniques, and methods for a rotatable hanger assembly that may be less cumbersome and may include other advantages not found in prior clamping or torqueing systems.

First Exemplary Embodiment of a Well System with a Rotatable Tubing Hanger

Referring to FIG. 1, in an exemplary embodiment, a well system 100 includes a wellhead 104 coupled to a casing 102 that extends down into a borehole 106. Wellhead 104 includes a tubing rotator 110 coupled to a casing head spool piece 108 at the top of casing 102. Tubing rotator 110 comprises a tubing hanger 120 received and held within a spool piece 111. A tubular string 112 is coupled to the lower end of tubing hanger 120 at a junction region 113 (also referred to herein as a junction 113) to provide axial support, torque transfer, and fluid sealing. In the embodiment shown, junction 113 is a single connection formed by a pair of mating, tapered threads, and thus, junction 113 may also be referred to as lower connection 113. A similar junction 113 is formed between each member of tubular string 112 to provide axial support, torque transfer, and fluid sealing.

Tubular string 112 extends into casing 102. In the example shown, tubular string 112 is a production tubing string, and well system 100 is an oil production system. An upwardly extending tubular member 114 is coupled to the top of tubing hanger 120 at a junction region 115 (also referred to herein as junction 115) for torque transfer and fluid sealing. In the embodiment shown, junction 115 is a single connection formed by a pair of mating, tapered threads. Junction 115 may also be referred to as upper connection 115. In at least some embodiments, junction 115 is also configured for axial support of hanger 120 and string 112; although, in various embodiments, spool piece 111 provides a majority or all of this axial support. A sucker rod 118 extends though tubing hanger 120 and tubular string 112 in order to draw hydrocarbons or water through string 112 when rod 118 reciprocates. During operation, mechanisms in tubing rotator 110 cause tubing hanger 120 and tubular string 112 to rotate in order to reduce or to distribute the wear in string 112 that would be caused by the reciprocation of rod 118 in order to extend the life of string 112.

Figure 2:
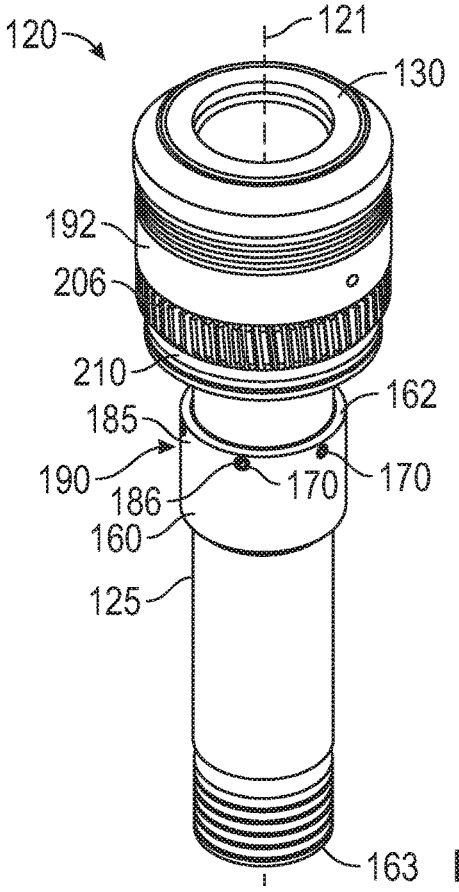
FIG. 2 is an isometric view of the tubing hanger of FIG. 1 having an upper mandrel and a lower mandrel.

Referring to FIG. 2, tubing hanger 120 includes a longitudinal axis 121, a tubular upper mandrel 130, a tubular lower mandrel 160 extending from upper mandrel 130, a tubular outer mandrel 192 disposed about upper mandrel 130. Hanger 120 further includes an annular gear 206 disposed about mandrel 130, and an annular sealing member 210 also disposed about mandrel 130. Mandrels 130, 160, 192 are concentrically aligned along axis 121. As will be described below, upper mandrel 130 and tubular lower mandrel 160 are coupled by multiple connections to form a unified mandrel 125. Upper and lower mandrels 130, 160 may also, therefore, be called segments of the unified mandrel 125.

Figure 3:
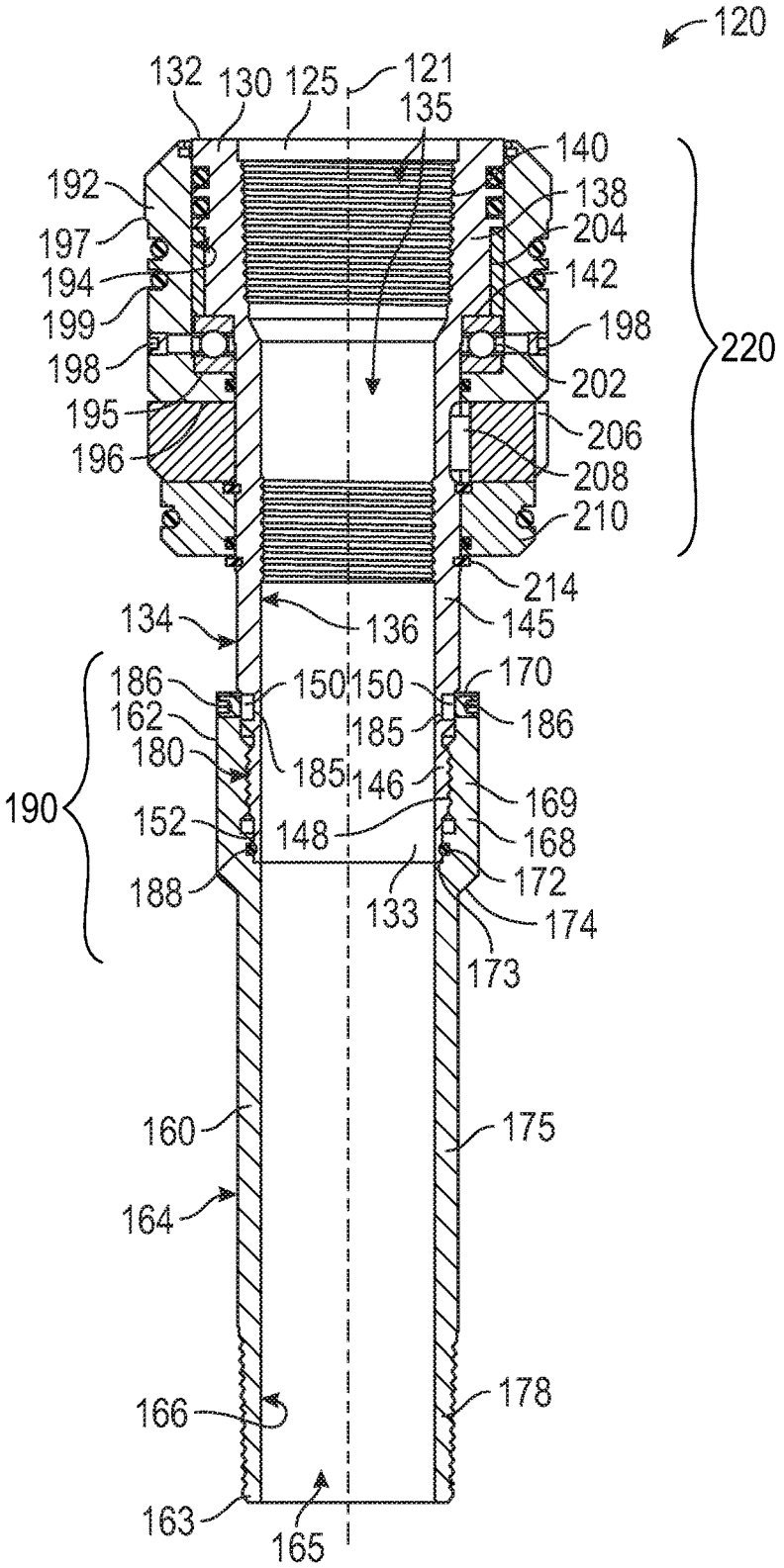
FIG. 3 is a side view in cross-section of the tubing hanger of FIG. 2.

Referring now to FIG. 3, upper mandrel 130 includes a first or upper end 132, a second or lower end 133, an external surface 134, and a through-bore 135 having an internal cylindrical surface 136. Moving lengthwise, mandrel 130 includes an enlarged, upper portion 138, a straight central portion 145, and a lower portion 146. Upper portion extends from upper end 132 and has an internally threaded upper segment 140 and an external shoulder 142. Lower portion 146 extends to lower end 133. External shoulder 142 is configured to be supported at the wellhead 104. Along external surface 134, lower portion 146 includes a lower threaded segment 148, at least one radially-extending bore 150, and a circumferentially-extending, non-threaded segment 152 between threaded segment 148 and lower end 133. Threaded segment 148 includes internal, non-tapered threads, which. The example of FIG. 3 includes a plurality of radially-extending bores 150 axially off-set from threaded segment 148, opposite lower end 133. Upper threaded segment 140 includes tapered threads, configured to threadingly couple with tubular member 114 that extends upward from tubing hanger 120 in well system 100 of FIG. 1.

Lower mandrel 160 includes a first or upper end 162, a second or lower end 163, an external surface 164, and a through-bore 165 forming an internal surface 166. Bores 135, 165 align to form a contiguous through-bore for hanger 120. Moving lengthwise, mandrel 160 includes an upper portion 168 extending from upper end 162, a straight, central portion 175, and a lower, threaded portion or segment 178 extending to lower end 163. Along internal surface 166, upper portion 168 includes an upper threaded segment 169, at least one radially-extending through-bore 170, a circumferential groove 172, and an internal shoulder 173. Threaded segment 169 includes internal, non-tapered threads. Upper portion 168 has an outside diameter that is larger than the outside diameter of central portion 175, resulting in an external shoulder 174 that can be used to support lower mandrel 160 and a coupled tubular string 112 while upper mandrel 130 is attached to lower mandrel 160. The lower threaded segment 178 includes tapered threads, configured to couple threadingly to the end of tubing string 112.

Referring still to FIG. 3, when hanger 120 is assembled, upper and lower mandrels 130, 160 are joined by multiple couplings with each coupling performing at least one task. The inclusion of multiple couplings eliminates the need for making a threaded connection involving tapered threads at a particular stage of installing hanger 120 on tubular string 112 and in wellhead 104. In the example of FIG. 3, lower end 133 of upper mandrel 130 and the upper end 162 of lower mandrel 130 are joined by three connections. A first connection 180 is configured to engage by rotation and, in the example of FIG. 3, includes the mating threaded segments 148, 169. Connection 180 is configured to transfer axial force between mandrels 130, 160, restraining relative axial movement therebetween. In various embodiments, connection 180 is tightened by rotating the lower end 133 of upper mandrel 130 in first, make-up direction, to engage it against the internal shoulder 173 of lower mandrel 160. Once engaged, the connection 180, which also includes end 133 and shoulder 173, is further configured to transfer torque between mandrels 130, 160, restraining relative rotation therebetween, in at least the make-up direction. When mandrels 130, 160 are assembled, each bore 150 aligns with a bore 170, forming a pair.

A second connection 185 includes at least one pin member 186 disposed at least partially within a pair of aligned bores 150, 170. The embodiment shown, second connection 185 includes a plurality of pin members 186, one pin member disposed at least partially in each pair of aligned radially-extending bores 150, 170. Each pin member 186 may be selected from a group that includes a rod, a set screw, a threaded fastener, and similar compatible members. Connection 185 is configured to prevent (e.g. to inhibit or to reduce the potential for) the first connection 180 from loosening or disengaging when a reverse torque, a torque opposite the make-up direction, is applied to mandrels 130, 160. For this purpose reason, connection 185 is configured to transfer toque between mandrels 130, 160 at least in a second direction opposite the make-up direction, inhibiting relative rotation therebetween. Torque applied in the second direction will also be called reverse torque. Reverse torque may be needed, for example, to unset an anchor down-hole. For various embodiments, connection 185 is likewise configured to transfer forward toque between mandrels 130, 160 in the make-up direction; although, in practice, tension in the tightened first connection 180 may result in little or no transfer of forward torque by connection 185.

An annular seal 188 is located between mandrels 130, 160 and is disposed in circumferential groove 172 where it engages the non-threaded segment 152 at the lower end 133 of upper mandrel 130. Seal 188 is, for example, a resilient annular, O-ring. Seal 188 seals between mandrels 130, 160 to inhibit fluid communication between the ends 133, 162, i.e. to inhibit leaking of a fluid. In the embodiment of FIG. 3, the first connection 180, second connection 185, and seal 188 are spaced-apart from one another. Once coupled by the connections 180, 185, mandrels 130, 160 form unified mandrel 125 that may be employed instead of the inner mandrel of a traditional tubing hanger.

Thus, in addition to being configured to form the upper and lower junctions 113, 115, hanger 120 includes an additional, intermediate junction region 190 (also referred to herein as junction 190), a junction not found in typical tubing hangers of tubing rotators. Junction 190 comprises the first and second connections 180 and 185 configured to perform individually the tasks of, respectively, (a) transfer of axial force to restrain relative axial movement and transfer of toque in at least a first rotational direction and (b) prevent the connection 180 from loosening by transferring toque in at least a second, opposite direction. At least in the embodiment shown, junction 190 also includes seal 188 which performs a third task: (c) providing fluid sealing between mandrels 130, 160 to prevent fluid communication, leaking between the ends of mandrels 130, 160. In at least some embodiments, one or both of the connections 180 and 185 of junction 190 is configured to perform more than one of the tasks that include (a) transfer of axial force to restrain relative axial movement, (b) transfer toque and inhibit relative rotation in one or both directions, and (c) seal mandrels 130, 160 to prevent fluid communication from inside to outside, e.g. leaking. In contrast to junction 190, the lower junction 113 on hanger 120 in FIG. 1, is formed by a single, threaded connection that includes a pair of highly-torqued, tapered threads configured to perform all three tasks: transfer of axial force to restrain axial movement, transfer toque in both directions to inhibit relative rotation, and seal two tubular members to prevent fluid leaking. In at least some embodiments, upper junction 115 is configured similar to lower junction 113.

Referring again to FIG. 2 and FIG. 3, outer mandrel 192 is generally tubular and includes an through-bore 194 forming an internal shoulder 195 adjacent lower end 196, an external shoulder 197 adjacent the upper end, plugged through-bores 198 adjacent internal shoulder 195, and external grooves 199 that receive annular sealing members such as O-rings or packing, for example. External shoulder 197 is configured to be supported within tubing rotator spool piece 111, which therefore supports hanger 120. Outer mandrel 192 may also be called the head or head member of the hanger assembly. Upper portion 138 of upper mandrel 130 is retained within the outer mandrel through-bore 194, and lower portion 146 extends axially beyond the lower end of through bore 194. Mandrel 130 is supported axially upward at the upper portion 138 by a thrust bearing 202 installed between external shoulder 142 and internal shoulder 195 inside mandrel 192. One or more radially-extending through-bores 198 in mandrel 192 provide a path for adding grease to bearing 202. An annular bushing 204 is located within through-bore 194 radially between outer mandrel 192 and upper portion 138 of upper mandrel 130. Thus, the shoulder 195 of outer mandrel 192 is configured to support an axial load from the upper mandrel 130, and upper mandrel configured to rotate relative to outer mandrel 192 on bearing 202 and, if necessary, against bushing 204.

Figure 4:
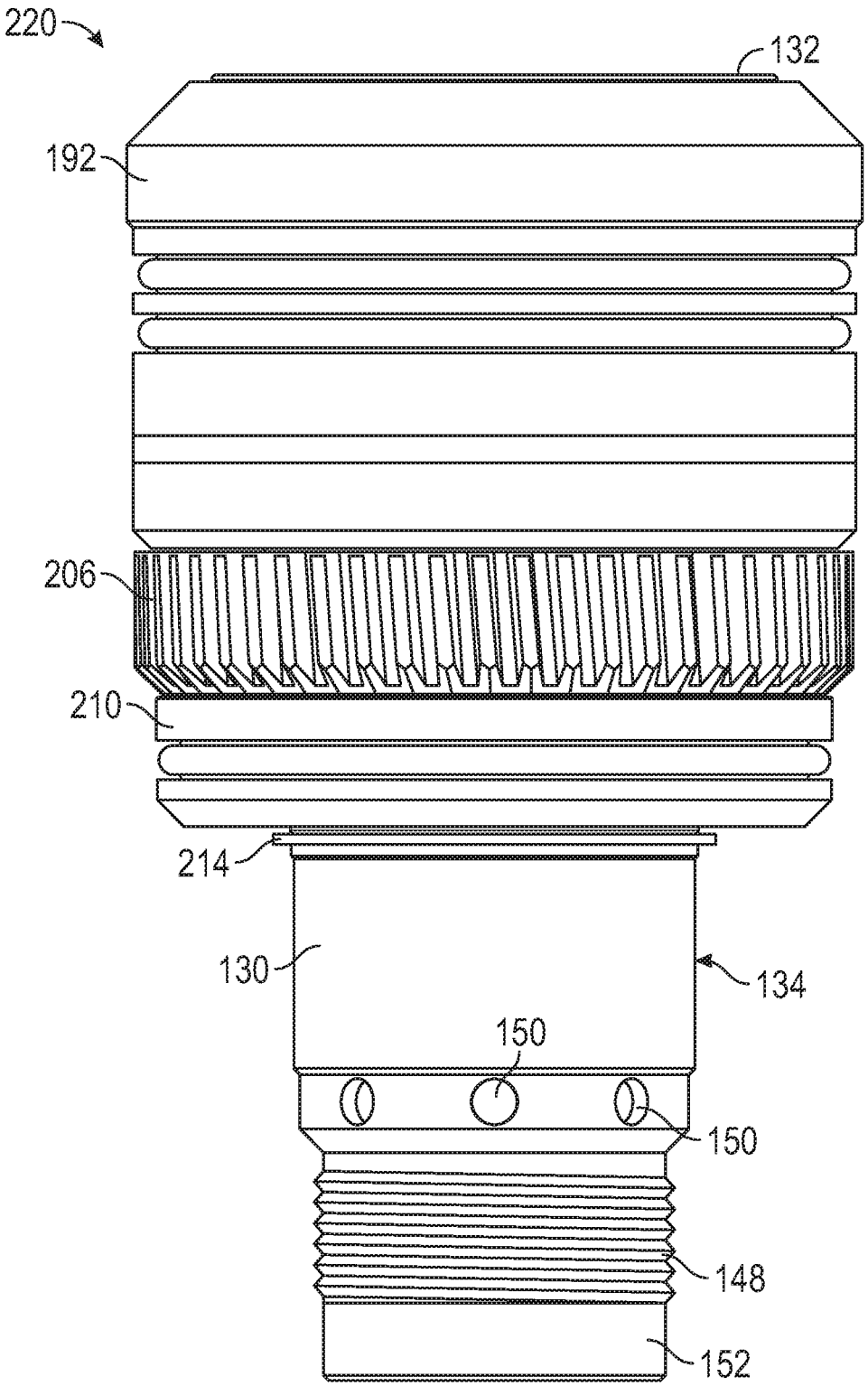
FIG. 4 side view of the upper mandrel of the tubing hanger of FIG. 2.

Annular gear 206 extends circumferentially about upper mandrel 130 and is axially positioned against lower end 196 of outer mandrel 192. Annular gear 206 is rotationally fixed to mandrel 130 by a key 208 located in slots between members 206, 130. Annular sealing member 210 extends circumferentially about upper mandrel 130 and is axially positioned against gear 206. Gear 206, seal 210, bearing 202, and outer mandrel 192 are held against external shoulder 142 of upper mandrel 130 by a lock ring 214, forming a hanger upper assembly 220. FIG. 4 shows a side view of the upper assembly 220. Typically, hanger upper assembly 220 is completed prior to coupling the upper mandrel 130 to the lower mandrel 160.

In various embodiments, at least one member of hanger upper assembly 220 includes an outside diameter that is larger than the inner diameter of a circumferentially-closed, gripping head or the chuck of a power tongs (not shown) that may be selected or needed for threading the lower mandrel 160 to the upper end of tubular string 112 (FIG. 1). As examples, the outer mandrel 192 or the upper portion 138 may include an outside diameter that is larger than the inner diameter of the gripping head of the power tongs. In contrast, in at least these embodiments, the maximum outside diameter of lower mandrel 160 is less than inner diameter of a circumferentially-closed, gripping head or the chuck of a power tongs that receives an object to be gripped and torqued. Consequently, the entirety of lower mandrel 160 may pass axially through the selected power tongs so that the power tongs may be used to thread mandrel 160 to tubular string 112. During operation, to accommodate the larger diameter of the member of hanger upper assembly 220, the power tongs are removed from its position around or above lower mandrel 160 before the upper mandrel 130 is coupled to the lower mandrel 160. After the power tongs are removed, the first and second, connections 180, 185 are made between mandrels 130, 160 to form junction 190 and unified mandrel 125.

The inclusion of the additional junction 190 results in additional machining steps while hanger 120 is being fabricated, particularly as a result of junction 190 comprising the multiple connections 180, 185 and seal 188 rather than just a single, sealing connection formed with tapered threads. However, this additional machining during manufacture is offset by an operational benefit of using a power tongs to attach a tubing hanger 120 to a tubing string 112 when the power tongs and the tubing hanger both include a circumferentially-closed, circular head that spans 360° without a split, and when the outer diameter of the tubing hanger is larger than the internal diameter of the head on the power tongs. In the disclosed example of tubing hanger 120, either the outer mandrel 192 or the enlarged, upper portion 138 of upper mandrel 130 may be considered to be the circumferentially-closed, circular head. In contrast, for a conventional tubing hanger that has circumferentially-closed, circular head and a single-piece mandrel, the lower junction between the tubing hanger and tubing string cannot be made-up with a power tong that has a circumferentially-closed, circular head if the power tong is to be removed.

Other Exemplary Embodiments of Connections Between Upper and Lower Mandrels

Figure 5:
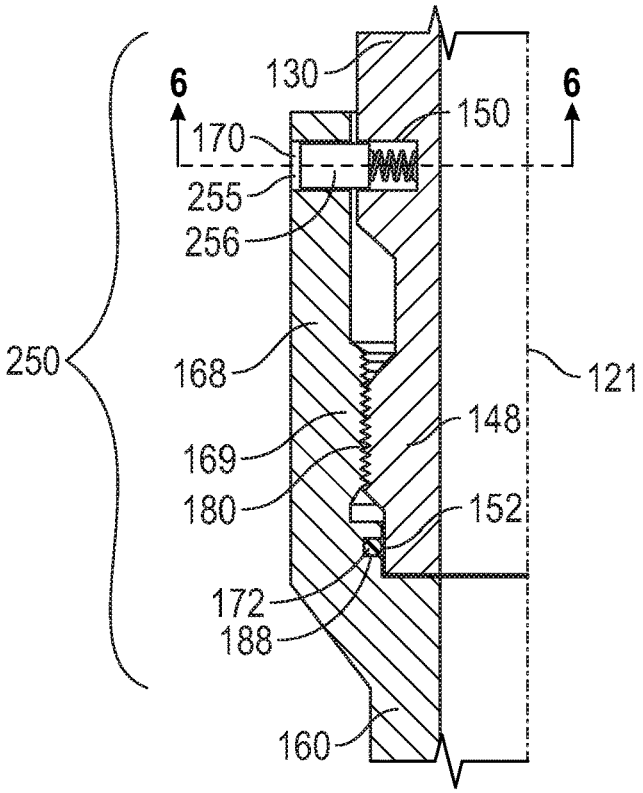
FIG. 5 is a close side view in cross-section of another embodiment, which includes a spring-loaded pin for coupling a lower mandrel to an upper mandrel, and which is suitable for use in the tubing hanger of FIG. 2.
Figure 6:
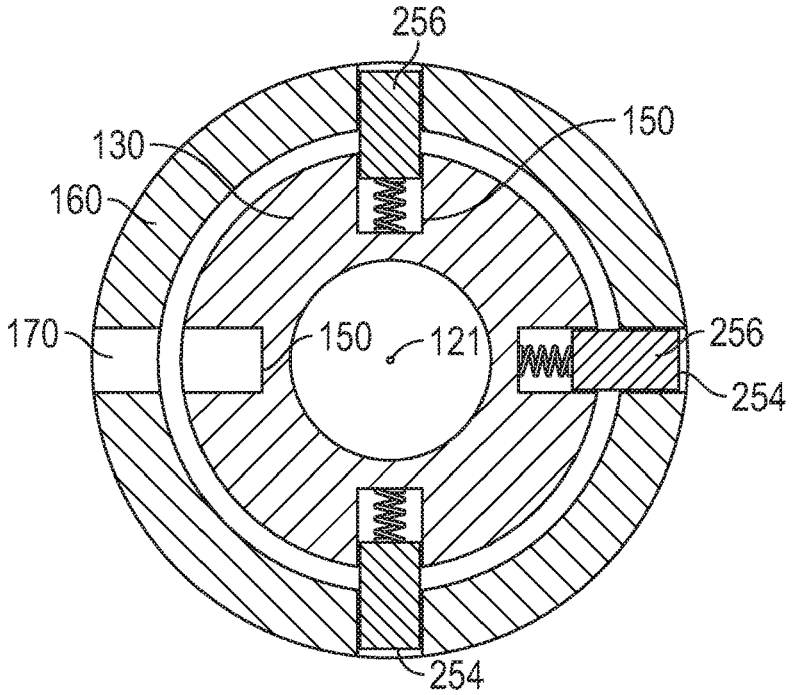
FIG. 6 is a top view of the tubing hanger of FIG. 5 through the section A-A.

FIG. 5 and FIG. 6 present another embodiment compatible with tubing hanger 120 and system 100, the embodiment including an intermediate junction 250 formed between an upper mandrel 130 and a lower mandrel 160. Mandrels 130, 160 are as previously described with reference to FIGS. 2, 3, and 4. The example of FIGS. 5 and 6 includes four pair of aligned bores 150, 170. Intermediate junction 250 comprises multiple connections 180, 255 configured to perform individually the tasks of, respectively, (a) transfer of axial force to restrain relative axial movement and transfer of toque in at least a first rotational direction and (b) prevent the connection 180 from loosening by transferring toque in at least a second, opposite direction. Junction 250 also includes a seal 188, to perform a third task: (c) seal mandrels 130, 160 to prevent fluid leaking. As in the junction 190 of FIG. 3, one or both of the connections 180, 255 may be configured in junction 250 to perform more than one of the tasks, assisting the other connection 180, 255.

As previously described, the first connection 180 is configured to engage by rotation and, in this example, includes the mating threaded segments 148, 169. The second connection 255 of junction 250 comprises the four pair of aligned bores 150, 170 with a biased pin 256 installed in each pair. Each biased pin 256 comprises a biasing member adjacent a pin member that may be selected from a group that includes a rod, a set screw, a threaded fastener, and similar compatible members. In FIG. 5 and FIG. 6 the biasing member is a spring located between the bottom of bore 150 and the proximal end of the pin member and configured to develop a radially outward force with respect to longitudinal axis 121. As previously described, seal 188 is located between mandrels 130, 160 and includes a sealing member disposed in circumferential groove 172 and engaging the non-threaded segment 152 of upper mandrel 130. In the example of FIG. 5, the rotational connection 180 is completed without tightening lower end 133 of upper mandrel 130 against internal shoulder 173; although, other embodiments may include lower end 133 torqued against internal shoulder 173.

Figure 7:
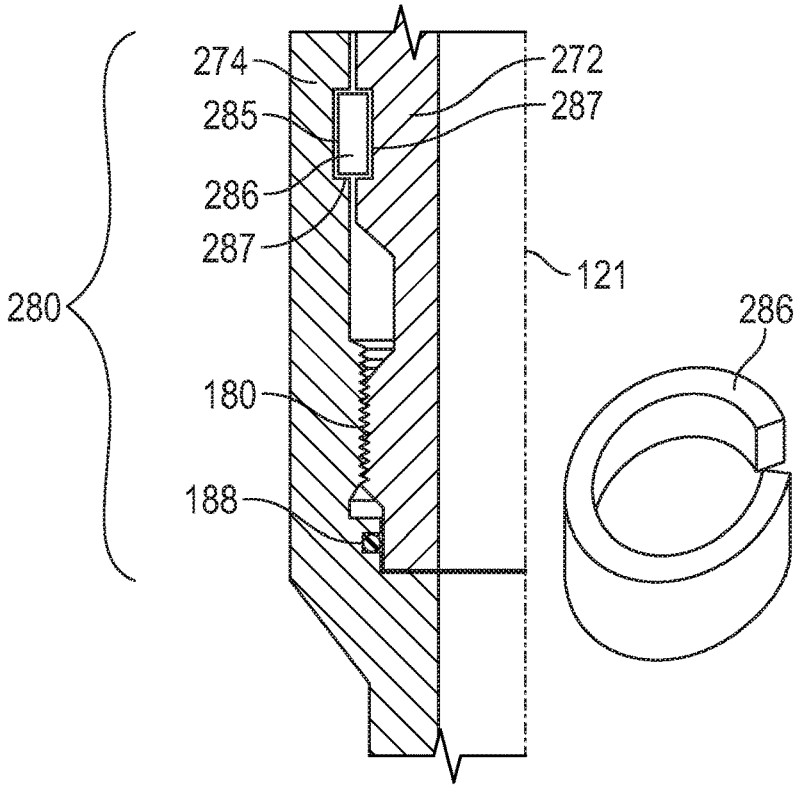
FIG. 7 is a close side view in cross-section of still another embodiment, that includes a retractable/expandable ring for coupling a lower mandrel to an upper mandrel, and which is suitable for use in the tubing hanger of FIG. 2.

FIG. 7 shows still another embodiment compatible with tubing hanger 120 and system 100, the embodiment includes an intermediate junction 280 formed between an upper mandrel 272 and a lower mandrel 274 extending along a longitudinal axis 121. Mandrels 272, 274 are like mandrels 130, 160, respectively, except for the differences described below. Intermediate junction 280 comprises multiple connections 180 and 285 configured to perform individually the tasks of, respectively, (a) transfer of axial force to restrain relative axial movement and transfer of toque in at least a first rotational direction and (b) prevent the connection 180 from loosening by transferring toque in at least a second, opposite direction. Junction 280 also includes a seal 188, to perform a third task: (c) seal mandrels 272, 274 to prevent fluid communication. One or both of the connections 180, 285 may be configured to perform more than one of the tasks, assisting another of the connection 180, 285.

The first connection 180 and seal 188 are the same as previously described. The second connection 285 comprises a retainer ring 286 held between two grooves 287, proximal the first connection 180. One groove 287 is formed in the outer surface of the lower portion of upper mandrel 272. Thus, upper mandrel 272 has an external groove 287 rather than a bore 150. The second groove 287 is formed in the inner surface of the upper portion of lower mandrel 274. Thus, lower mandrel 274 has an internal groove 287 rather than a through-bore 170. In the example shown, a retainer ring 286 is flat, having a rectangular cross-section disposed parallel to axis 121, and the grooves 287 are properly sized to receive ring 286. Ring 286 is an example of an annular locking member disposed about at least part of an upper mandrel and at least part of a lower mandrel.

Figure 8:
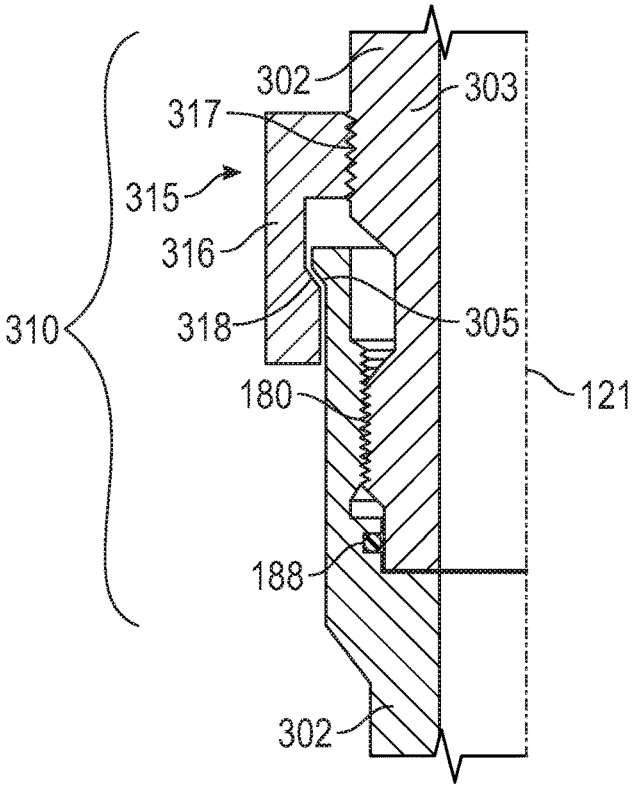
FIG. 8 is a close side view in cross-section of still another embodiment that includes a threaded ring for coupling a lower mandrel to an upper mandrel and which is suitable for use in the tubing hanger of FIG. 2.

FIG. 8 shows yet another embodiment compatible with tubing hanger 120 and system 100, the embodiment includes an intermediate junction 310 formed between an upper mandrel 302 and a lower mandrel 304 extending along a longitudinal axis 121. Mandrels 302, 304 are like mandrels 130, 160, respectively, except for the following differences described below. The lower portion of upper mandrel 302 includes an additional threaded segment 303 having external threads, which at least in this example are non-tapered threads. As assembled, threaded segment 303 is axially spaced-apart from lower mandrel 304. The upper portion of lower mandrel 304 includes an external, annular shoulder 305 that faces axially away from the majority of upper mandrel 302. Thus, upper mandrel 302 has a threaded segment 303 rather than a bore 150, and lower mandrel 304 has an external shoulder 305 rather than a through-bore 170.

Intermediate junction 310 comprises three connections 180, 315 and seal 188. Except for the differences described here, the configuration and performance of junction 310 is similar to that of junctions 190, 250, described above. For example, the configuration and performance of the first connection 180 and the seal 188 are the same as described previously. The second connection 315 is configured at least to transfer toque and inhibit relative rotation. Connection 315 comprises a threaded retainer ring 316 having an internally-threaded segment 317 spaced-apart from an internal shoulder 318. To form second connection 315, shoulder 318 engages shoulder 305, and threaded segments 303, 317 engage. Retainer ring 316 is configured as an annular locking member circumferentially disposed about at least part of the upper mandrel 302 and at least part of the lower mandrel 303.

Figure 9:
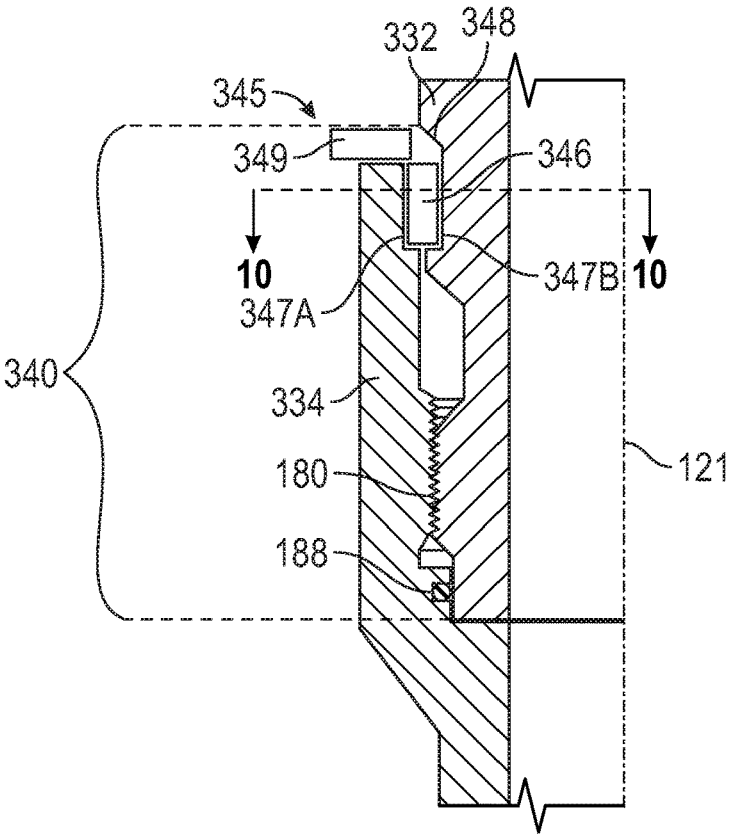
FIG. 9 is a close side view in cross-section of again another embodiment that includes an axially-parallel pin for coupling a lower mandrel to an upper mandrel, and which is suitable for use in the tubing hanger of FIG. 2.
Figure 10:
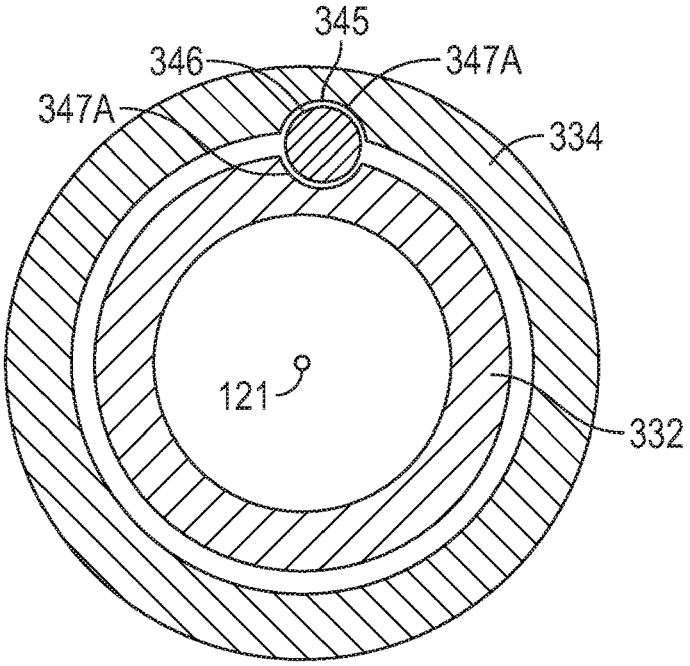
FIG. 10 is a top view of the tubing hanger of FIG. 9 through the section B-B.

FIG. 9 and FIG. 10 show yet another embodiment compatible with tubing hanger 120 and system 100, the embodiment includes an intermediate junction 340 formed between an upper mandrel 332 and a lower mandrel 334 extending along a longitudinal axis 121. Mandrels 332, 334 are like mandrels 130, 160, respectively, except for the differences described here. An axially-parallel slot 347A extends downward from the upper end of lower mandrel 344. Another axially-parallel slot 347B is located in the lower portion of upper mandrel 332. The lower portion of slot 347B is aligned with slot 347A; the upper portion of slot 347B extends along upper mandrel 332 beyond the upper end of lower mandrel 334, and a circumferential, external shoulder 348 is located around the upper end of slot 347B on mandrel 332. Thus, upper mandrel 332 has an external slot 347B rather than a bore 150, and lower mandrel 334 has an internal slot 347A rather than a through-bore 170.

Intermediate junction 340 comprises three connections 180, 345 and seal 188. Except for the differences described here, the configuration and performance of junction 340 is similar to that of junctions 190, 250, described above. For example, the configuration and performance of the first connection 180 and the seal 188 are the same as described previously. The second connection 345 is configured at least to transfer toque and inhibit relative rotation and comprises a key 346 held between the two slots 347A,B. In the example shown, a key 346 is round pin disposed parallel to axis 121, and each of the slots 347A,B has a semicircular cross-section to receive key 346. In addition, second connection 345 includes a retainer ring 349 that extends circumferentially about at least a portion of mandrels 332, 324 being held against shoulder 348 and the top of lower mandrel 334. Retainer ring 349 is configured as an annular locking member circumferentially disposed about at least part of the upper mandrel 302 and disposed adjacent or around at least part of the lower mandrel 303. Retainer ring 349 encloses and retains key 346 within the slots 347 A, B.

Further Exemplary Embodiment of a Well System with a Rotatable Tubing Hanger

Figure 11:
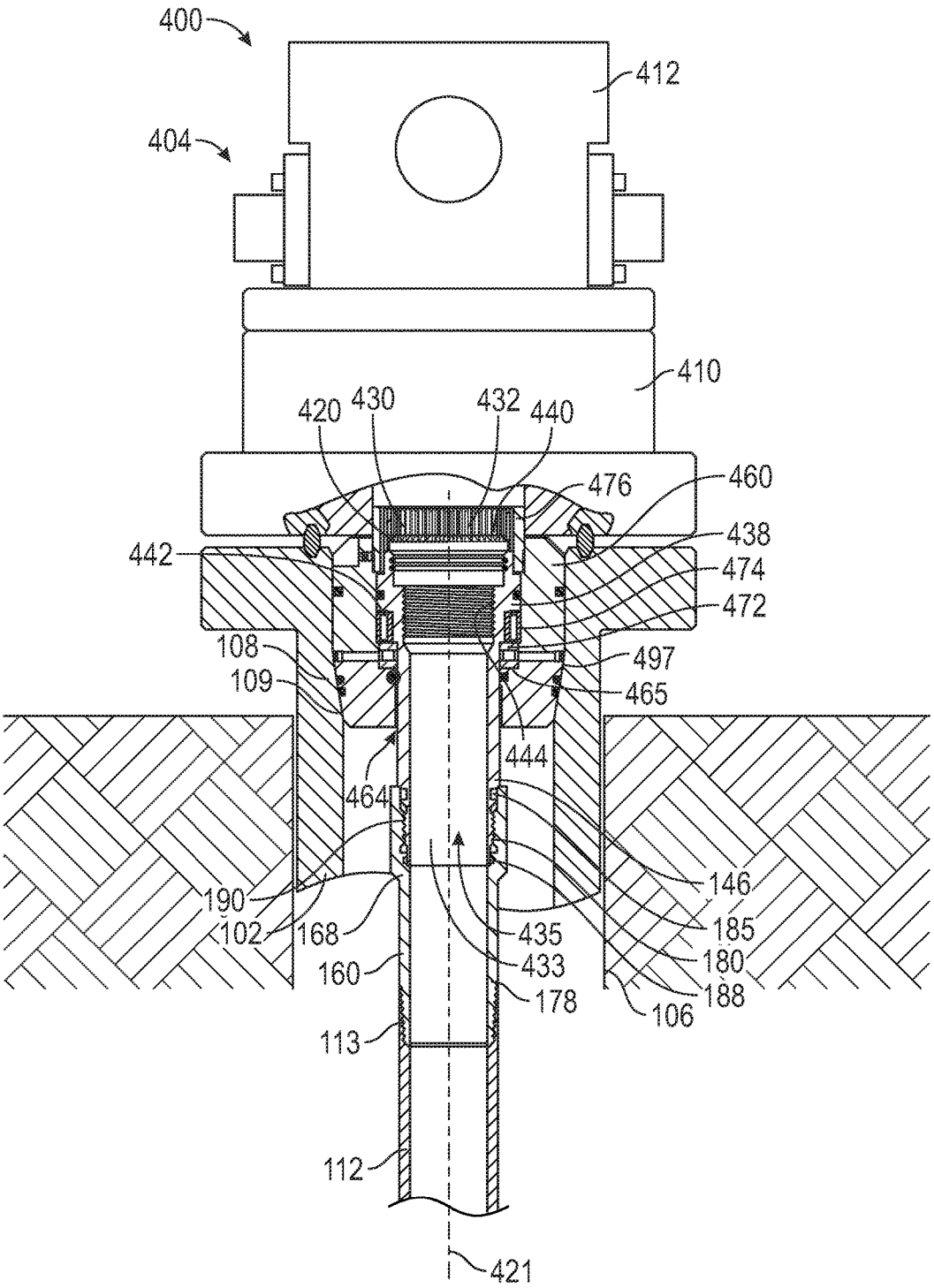
FIG. 11 an elevation view in partial cross-section of an embodiment of a well system having another tubing hanger in accordance with principles disclosed herein.

FIG. 11 discloses another exemplary embodiment of a well system and a rotatable tubing hanger. Well system 400 is similar to system 100, but system 400 includes a tubing rotator 410 and a tubing hanger 420 in place of rotator 110 and tubing hanger 120. Well system 400 includes a casing 102 extending down from a wellhead 404 into a wellbore 106, which may also be called a borehole. Casing 102 includes casing head spool piece 108 coupled to a tubing rotator 410. Also shown in FIG. 11 is a blow-out-preventer (BOP) 412 coupled above the rotator 410. Tubing hanger 420 is received and supported within casing spool piece 108 at a support section 109, which includes an enlarged inner diameter located above an annular shoulder. Hanger 420 is located below rotator 410, but the upper end of hanger 420 may extend into rotator 410 and is coupled to rotator 410 for rotation. A tubular string 112 is coupled by tapered threads to the lower end of tubing hanger 420 at a lower connection or junction 113 for axial and support, torque transfer, and fluid sealing. Tubular string 112 extends into casing 102. In the example shown, tubular string 112 is a production tubing string, and well system 400 is an oil production system. In various embodiments, a sucker rod like rod 118 (not shown in FIG. 11) extends though tubing hanger 420 and tubular string 112 in order to draw hydrocarbons or water upward.

During operation, mechanisms in tubing rotator 410 cause tubing hanger 420 and tubular string 112 to rotate in order to reduce or to distribute the wear in string 112 caused by the reciprocation of sucker rod and thereby to extend the life of string 112. Tubing hanger 420 provides the same operational benefit as was described with respect to hanger 120 of FIGS. 1-4, above.

Tubing hanger 420 includes a longitudinal axis 421, a tubular upper mandrel 430, a tubular lower mandrel 160 extending from mandrel 430, and a tubular outer mandrel 460 disposed about mandrel 430. Mandrels 430, 160, 460 are concentrically aligned along axis 421.

Upper mandrel 430 includes a first or upper end 432, a second or lower end 433, and a through-bore 435 forming an internal surface. Lengthwise, mandrel 430 includes an upper portion 438 extending from upper end 432 with an internal spline 440 and an external shoulder 442, and a lower portion 146 extending to lower end 433. Upper portion 438 includes an internal spline 440 configured to couple to rotator 410 for rotation, an external shoulder 442 configured to be supported by outer mandrel 460 and by wellhead 104, and internal threads 444 distal end 432 spaced from spline 440. Internal threads 444 are configured to hold an internal check valve within through-bore 435. Lower portion 146 is the same as previously described with reference to FIG. 3 and may be replaced by the lower portion of any compatible upper mandrel embodiment disclosed herein, for example in any of the FIGS. 5-10.

Continuing to reference FIG. 11, lower mandrel 160 is the same as the same as previously described with reference to FIGS. 3 and 4. For example, mandrel 160 in FIG. 11 includes an upper portion 168 and a lower, threaded portion or segment 178. In various embodiments, upper portion 168 may be replaced by the upper portion of any lower mandrel embodiment disclosed herein, to match the lower portion that may be selected to replace lower portion 146 of upper mandrel 430, as discussed above.

Referring still to FIG. 11, upper mandrel 430 is coupled to lower mandrel 160 by an intermediate junction 190, which is the same as the same as previously described, comprising multiple couplings or connections 180, 185, and seal 188. The connections are configured to perform the respective task or tasks previously described. The inclusion of multiple couplings eliminates the need for making a threaded connection involving tapered threads at a particular stage of installing hanger 420 on tubular string 112 and within wellhead 404. In various other embodiments, intermediate junction 190 may be replaced by any of the intermediate junctions 250, 280, 310, 340 disclosed herein.

Outer mandrel 460 is generally tubular and includes a through-bore 464 forming an internal shoulder 465, an external shoulder 497, and external grooves that receive annular sealing members such as O-rings or packing, for example. External shoulder 497 is configured to be supported within the casing spool piece 108 at support section 109, which therefore supports hanger 420. Upper portion 438 of upper mandrel 430 is retained within the outer mandrel through-bore 464, and lower portion 146 extends axially beyond the lower end of through bore 464. Mandrel 430 is supported axially upward by a thrust bearing 472 installed between external shoulder 442 and internal shoulder 465 of mandrel 460. A cylindrical roller bearing 474 is located within through-bore 464 radially between outer mandrel 460 and upper portion 438 of upper mandrel 430. Thus, the shoulder 465 of outer mandrel 460 is configured to support an axial load from the upper mandrel 430, and upper mandrel 430 configured to rotate relative to outer mandrel 460 on bearing 472 and, as needed, against the bearing 474. An annular retaining nut 476 installed at the upper end of mandrel 460 of retains mandrel 430 and bearings 472, 474 within mandrel 460.

A Method

Figure 12:
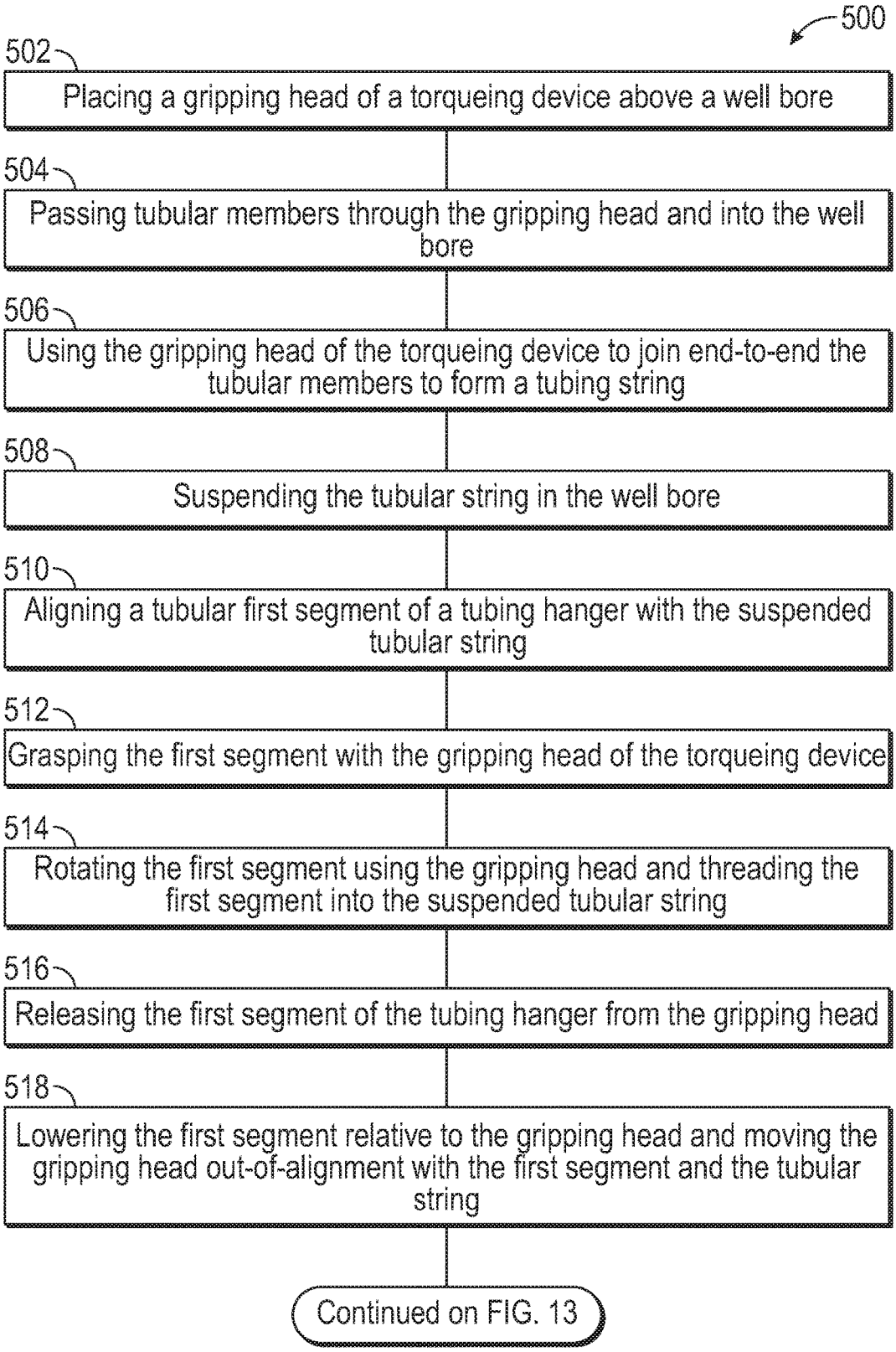
FIG. 12 shows a flow diagram showing a method for coupling threaded tubular members end-to-end to install the tubing hanger of FIG. 2 in accordance with principles disclosed herein.
Figure 13:
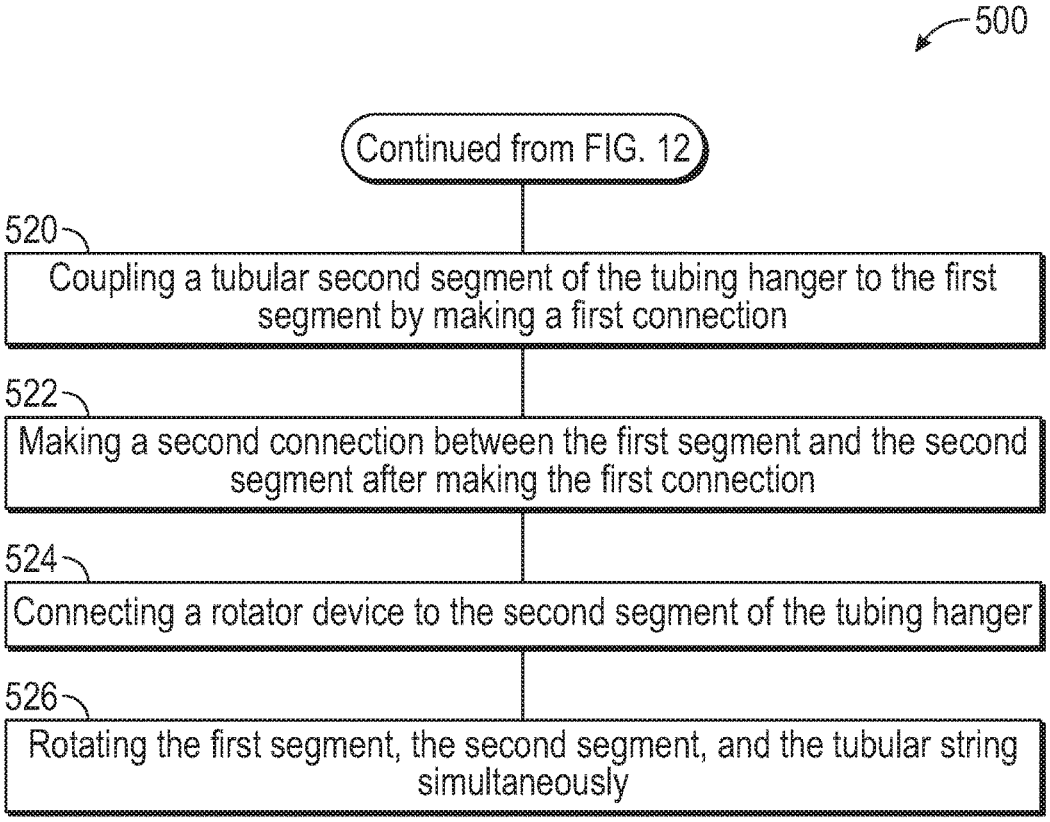
FIG. 13 shows a continuation of the method of FIG. 12.

FIG. 12 and FIG. 13 shows a method 500 for coupling threaded tubular members end-to-end to install a tubing hanger in accordance with the principles described herein. At block 502, method 500 includes placing a gripping head of a torqueing device above a well bore. Block 504 includes passing tubular members through the gripping head and into the well bore. Block 506 includes using the gripping head of the torqueing device to join end-to-end the tubular members to form a tubing string. Block 508 includes suspending the tubular string in the well bore. Block 510 includes aligning a tubular first segment of a tubing hanger with the suspended tubular string. Block 512 includes grasping the first segment with the gripping head of the torqueing device. Block 514 includes rotating the first segment using the gripping head and threading the first segment into the suspended tubular sting. Block 516 includes releasing the first segment of the tubing hanger from the gripping head. Block 518 lowering the first segment relative to the gripping head and moving the gripping head out-of-alignment with the first segment and the tubular string. Block 520 includes coupling a tubular second segment of the tubing hanger to the first segment by making a first connection. Block 522 includes making a second connection between the first segment and the second segment after making the first connection. Block 524 includes connecting a rotator device to the second segment of the tubing hanger. Block 526 includes rotating the first segment, the second segment, and the tubular string simultaneously. Thus, method 500 provides the same operational benefit as was described with respect to hanger 120 of FIGS. 1-4, above, which includes the ability to use a power tongs to attach a tubing hanger to a tubing string when the power tongs and the tubing hanger both include a circumferentially-closed, circular head that spans 360° without a split, and when the outer diameter of the tubing hanger is larger than the internal diameter of the head on the power tongs.

Various embodiments of method 400 may include fewer operations than described here, and other embodiments of method 400 include additional operations based on other concepts presented in this specification, including the figures.

Additional Information

While exemplary embodiments have been shown and described, modifications thereof can be made by one of ordinary skill in the art without departing from the scope or teachings herein. The embodiments described herein are exemplary only and are not limiting. Many variations, combinations, and modifications of the systems, apparatus, and processes described herein are possible and are within the scope taught by this disclosure. Accordingly, the scope of protection is not limited to the embodiments described herein, but is only limited by the claims that follow, the scope of which shall include all equivalents of the subject matter of the claims. The inclusion of any particular method step or operation within the written description or a figure does not necessarily mean that the particular step or operation is necessary to the method. If feasible, the steps or operations of a method may be performed in any order, except for those particular steps or operations, if any, for which a sequence is expressly stated. In some implementations two or more of the method steps or operations may be performed in parallel, rather than serially.

What is claimed is:

1. A tubing hanger for supporting a tubing string from a wellhead, comprising:

an outer mandrel comprising an outer mandrel through-bore and an external shoulder configured to be supported by the wellhead;

an upper mandrel comprising a first portion retained within the outer mandrel through-bore and a second portion extending axially beyond the outer mandrel through-bore along a longitudinal axis;

a lower mandrel axially aligned with and coupled to the second portion of the upper mandrel by a plurality of connections and comprising a threaded segment configured to couple threadingly to the tubing string;

wherein a first connection of the plurality of connections is configured to restrain axial movement between the upper mandrel and the lower mandrel and to transfer torque between the upper mandrel and the lower mandrel in at least a first rotational direction; and wherein a second connection of the plurality of connections is configured to transfer torque between the upper mandrel and the lower mandrel in at least a second rotational direction opposite the first rotational direction, to prevent the first connection from loosening; and wherein the second connection is axially-spaced from the first connection.

2. The tubing hanger of claim 1 wherein the wellhead includes a tubing rotator spool piece, and at least a portion of the upper mandrel is received in the tubing rotator spool piece; and wherein the outer mandrel through-bore is configured to permit the upper mandrel to rotate relative to the outer mandrel.

3. The tubing hanger of claim 1 wherein the first connection comprises mating, non-tapered threads; and wherein the second connection comprises: a first radially-extending bore disposed in the upper mandrel, a second radially-extending bore disposed in the lower mandrel, and a pin member configured to be received at least partially within each of the first and second radially-extending bores.

4. The tubing hanger of claim 1 further comprising: a sealing member disposed between the upper mandrel and the lower mandrel and spaced-apart from the first and second connections;

wherein the first and second connections and the sealing member are proximal a first end of the lower mandrel.

5. The tubing hanger of claim 1 wherein the first connection comprises mating, non-tapered threads.

6. The tubing hanger of claim 5 wherein the non-tapered threads comprise ACME threads.

7. The tubing hanger of claim 5 wherein the second connection comprises: a first radially-extending bore disposed in the upper mandrel, a second radially-extending bore disposed in the lower mandrel, and a pin member configured to be received at least partially within each of the first and second radially-extending bores.

8. The tubing hanger of claim 5 wherein the second connection comprises an annular locking member disposed about at least part of the upper mandrel and at least part of the lower mandrel.

9. The tubing hanger of claim 5 wherein the second connection comprises a key disposed between a first slot in the upper mandrel and a second slot in the lower mandrel.

10. The tubing hanger of claim 9 wherein the second connection further comprises a retainer ring circumferentially disposed about at least part of the upper mandrel and at least part of the lower mandrel and configured to retain the key disposed within the first and second slots.

11. A method for coupling threaded tubular members end-to-end, the method comprising:

placing a gripping head of a torqueing device above a well bore;

passing tubular members through the gripping head and into the well bore;

using the gripping head of the torqueing device to join end-to-end the tubular members to form a tubing string;

suspending the tubular string in the well bore;

aligning a tubular first segment of a tubing hanger with the suspended tubular string;

grasping the first segment with the gripping head of the torqueing device;

rotating the first segment using the gripping head and threading the first segment into the suspended tubular sting;

releasing the first segment of the tubing hanger from the gripping head;

lowering the first segment relative to the gripping head and moving the gripping head out-of-alignment with the first segment and the tubular string;

coupling a tubular second segment of the tubing hanger to the first segment by making a first connection;

making a second connection between the first segment and the second segment after making the first connection;

connecting a rotator device to the second segment of the tubing hanger; and rotating the first segment, the second segment, and the tubular string simultaneously.

12. The method of claim 11 further comprising passing the first segment of the tubing hanger axially through the gripping head while the tubing string is suspended in the well bore and before the gripping head has been moved out of alignment with the tubing string.

13. The method of claim 12 wherein placing a gripping head of a torqueing device around the first segment, and grasping the first segment with the gripping head is accomplished using power tongs.

14. The method of claim 11 wherein making the first connection comprises joining a pair of non-tapered threads; and wherein making the second connection comprises: installing a pin member into at least part of a first radially-extending bore disposed in the second segment and into at least part of a second radially-extending bore disposed in the first segment.

15. A tubing hanger for supporting a tubing string from a wellhead, comprising:

an outer mandrel comprising an outer mandrel through-bore and an external shoulder configured to be supported by the wellhead;

an upper mandrel comprising a first portion retained within the outer mandrel through-bore and a second portion extending beyond the outer mandrel through-bore;

a lower mandrel aligned with and coupled to the second portion of the upper mandrel and comprising a threaded segment configured to couple threadingly to the tubing string;

a threaded connection between the second portion of the upper mandrel and the lower mandrel configured for make-up in a first rotational direction and configured to restrain axial movement between the upper and lower mandrels; and a non-threaded connection between the second portion of the upper mandrel and the lower mandrel configured to transfer torque therebetween in at least a second rotational direction opposite the first rotational direction.

16. The tubing hanger of claim 15 wherein the threaded connection comprises mating, non-tapered threads.

17. The tubing hanger of claim 16 wherein the non-threaded connection comprises: a first radially-extending bore disposed in the second portion of the upper mandrel, a second radially-extending bore disposed in the lower mandrel, and a non-threaded pin member configured to be received at least partially within each of the first and second radially-extending bores.

18. The tubing hanger of claim 16 wherein the second connection comprises a key disposed between a first slot in the second portion of the upper mandrel and a second slot in the lower mandrel.

19. The tubing hanger of claim 15 wherein the threaded connection is further configured to transfer torque between the upper mandrel and the lower mandrel in at least the first rotational direction; and wherein the threaded connection is axially-spaced from the non-threaded connection along a longitudinal axis of the tubing hanger.

* * * * *